US011039653B2

(12) United States Patent
Tutunaru

(10) Patent No.: US 11,039,653 B2
(45) Date of Patent: Jun. 22, 2021

(54) FOOTBALL HELMET

(71) Applicant: Catalin Tutunaru, Cape Elizabeth, ME (US)

(72) Inventor: Catalin Tutunaru, Cape Elizabeth, ME (US)

(73) Assignee: Impact Solution LLC, Chatsworth, CA (US)

( * ) Notice: Subject to any disclaimer, the term of this patent is extended or adjusted under 35 U.S.C. 154(b) by 3 days.

(21) Appl. No.: 15/883,315

(22) Filed: Jan. 30, 2018

(65) Prior Publication Data

US 2018/0213875 A1 Aug. 2, 2018

Related U.S. Application Data

(60) Provisional application No. 62/452,577, filed on Jan. 31, 2017.

(51) Int. Cl.

| | |
|---|---|
| ***A42B 3/12*** | (2006.01) |
| ***A42B 3/06*** | (2006.01) |
| ***A42B 3/20*** | (2006.01) |

(52) U.S. Cl.

CPC ..... *A42B 3/128* (2013.01); *A42B 3/063* (2013.01); *A42B 3/122* (2013.01); *A42B 3/20* (2013.01); *A63B 2243/007* (2013.01)

(58) Field of Classification Search

CPC ..... A42B 3/128; A42B 3/063; A42B 3/122; A42B 3/20; A42B 3/00; A42B 3/06; A42B 3/062; A42B 3/064; A42B 3/065; A42B 3/066; A42B 3/069; A42B 3/12;

(Continued)

(56) References Cited

U.S. PATENT DOCUMENTS 2,296,335 A 9/1942 Brady
3,113,318 A * 12/1963 Marietta ..... A42B 3/20 2/9
3,174,155 A 3/1965 Pitman (Continued)

FOREIGN PATENT DOCUMENTS

EP 790787 B1 9/2000
WO 2000035307 A1 6/2000

(Continued)

OTHER PUBLICATIONS

International Search Report dated May 23, 2018 from corresponding PCT/US18/15852, pp. 6.

(Continued)

*Primary Examiner* — Jameson D Collier
*Assistant Examiner* — F Griffin Hall
(74) *Attorney, Agent, or Firm* — Nelson Mullins Riley & Scarborough LLP; Thomas J. Engellenner; Reza Mollaaghababa

(57) ABSTRACT

The present invention is a football helmet designed to reduce the occurrence of concussions and subconcussive impacts to the brain through the use of a novel system of materials and design implemented on the interior and exterior of the helmet. The helmet disclosed herein can include a new impact absorption system using cylindrical segments of viscoelastic foam with a sealed central void to absorb high energy impacts. In some aspects, the helmet disclosed herein includes a multi-layer helmet designed to absorb a wide range of potential impacts.

17 Claims, 11 Drawing Sheets

(58) Field of Classification Search
CPC ..... A42B 3/121; A42B 3/124; A42B 3/125; A42B 3/127; A42B 3/003; A42B 3/18
USPC .... 2/410, 411, 412, 413, 414, 417, 422, 424
See application file for complete search history.

(56) References Cited

U.S. PATENT DOCUMENTS

| | | | | |
|---|---|---|---|---|
| 3,186,004 | A | 6/1965 | Carlini | |
| 3,242,500 | A | 3/1966 | Derr | |
| 3,720,955 | A | 3/1973 | Rawlings | |
| 3,992,721 | A | 11/1976 | Morton | |
| 4,075,717 | A | 2/1978 | Lemelson | |
| 4,124,904 | A | 11/1978 | Matthes | |
| 4,223,409 | A | 9/1980 | Lee | |
| 4,627,114 | A * | 12/1986 | Mitchell | A42B 3/128 2/414 |
| 4,903,346 | A | 2/1990 | Reddemann et al. | |
| 4,937,888 | A * | 7/1990 | Straus | A42B 3/003 2/411 |
| 5,477,563 | A | 12/1995 | Gentes et al. | |
| 6,073,271 | A | 6/2000 | Alexander et al. | |
| 6,314,586 | B1 | 11/2001 | Duguid | |
| 6,421,840 | B1 | 7/2002 | Chen et al. | |
| 6,446,270 | B1 | 9/2002 | Durr | |
| 6,468,644 | B1 | 10/2002 | Hong et al. | |
| 6,854,133 | B2 * | 2/2005 | Lee | A42B 3/063 2/412 |
| 7,328,462 | B1 | 2/2008 | Straus | |
| 8,117,679 | B2 * | 2/2012 | Pierce | A42B 3/125 2/410 |
| 8,615,817 | B2 | 12/2013 | Phillips | |
| 8,640,267 | B1 | 2/2014 | Cohen | |
| 8,739,317 | B2 | 6/2014 | Abernethy | |
| 8,938,817 | B1 | 1/2015 | Baldi | |
| 9,683,622 | B2 | 6/2017 | Ferrara | |
| 9,737,106 | B1 | 8/2017 | Cannon, Jr. | |
| 9,795,180 | B2 | 10/2017 | Lowe et al. | |
| 9,861,153 | B2 | 1/2018 | Finisdore | |
| 9,943,129 | B2 | 4/2018 | Newman et al. | |
| 10,010,127 | B1 | 7/2018 | Shaffer et al. | |
| 10,362,829 | B2 | 7/2019 | Lowe | |
| 10,463,099 | B2 | 11/2019 | Allen et al. | |
| 10,561,189 | B2 | 2/2020 | Lee | |
| 2003/0200597 | A1 | 10/2003 | Dennis et al. | |
| 2004/0168246 | A1 | 9/2004 | Phillips | |
| 2005/0273911 | A1 | 12/2005 | Skiba et al. | |
| 2006/0059605 | A1 | 3/2006 | Ferrara | |
| 2006/0059606 | A1 | 3/2006 | Ferrara | |
| 2008/0155735 | A1 * | 7/2008 | Ferrara | A42B 3/121 2/412 |
| 2009/0044316 | A1 * | 2/2009 | Udelhofen | A42B 3/20 2/424 |
| 2009/0260133 | A1 | 10/2009 | Del Rosario | |
| 2010/0088807 | A1 | 4/2010 | Jeong et al. | |
| 2012/0017358 | A1 * | 1/2012 | Princip | A42B 3/065 2/414 |
| 2013/0133128 | A1 | 5/2013 | Hein et al. | |
| 2013/0174329 | A1 | 7/2013 | Hanson et al. | |
| 2013/0254978 | A1 * | 10/2013 | McInnis | A42B 3/28 2/413 |
| 2013/0340147 | A1 * | 12/2013 | Giles | A42B 3/00 2/412 |
| 2014/0259316 | A1 | 9/2014 | Katz | |
| 2015/0000011 | A1 | 1/2015 | Redpath et al. | |
| 2015/0089721 | A1 | 4/2015 | Hanna | |
| 2015/0101899 | A1 | 4/2015 | Russo | |
| 2015/0223546 | A1 * | 8/2015 | Cohen | A42B 3/127 2/412 |
| 2015/0305430 | A1 * | 10/2015 | Rush | A42B 3/124 2/412 |
| 2015/0359288 | A1 | 12/2015 | Woxing et al. | |
| 2016/0113348 | A1 | 4/2016 | Twardowski, Jr. et al. | |
| 2016/0120238 | A1 | 5/2016 | Duncan et al. | |
| 2016/0270471 | A1 | 9/2016 | Merrell | |
| 2016/0324247 | A1 | 11/2016 | Warmouth et al. | |
| 2017/0065018 | A1 | 3/2017 | Lindsay | |
| 2017/0127748 | A1 | 5/2017 | Sethumadhavan et al. | |
| 2017/0232327 | A1 | 8/2017 | Kuntz | |
| 2017/0265557 | A1 | 9/2017 | Mercado, Jr. et al. | |
| 2017/0303622 | A1 | 10/2017 | Stone et al. | |
| 2018/0132557 | A1 | 5/2018 | Torres | |
| 2018/0326288 | A1 | 11/2018 | Simpson | |
| 2019/0001650 | A1 * | 1/2019 | Sohn | B32B 5/26 |
| 2019/0014848 | A1 | 1/2019 | Tutunaru | |
| 2019/0029353 | A1 | 1/2019 | Ogata | |
| 2020/0163399 | A1 | 5/2020 | Tutunaru | |

FOREIGN PATENT DOCUMENTS

| | | | |
|---|---|---|---|
| WO | 2017001619 | A1 | 1/2017 |
| WO | 2017171694 | A1 | 10/2017 |
| WO | 2018144420 | A1 | 8/2018 |

OTHER PUBLICATIONS

International Written Opinion dated May 23, 2018 from corresponding PCT/US18/15852, pp. 7.
International Search Report and Written Opinion, PCT/US2016/024395, dated Jun. 16, 2016, 7 pages.
International Preliminary Peport on Patentability, PCT/US2016/024395, dated Jun. 13, 2017, 7 pages.
Sprenger, Stephan et al., Carbon fiber-reinforced composites using an epoxy resin matrix modified with reactive liquid rubber and silica nanoparticles, Dec. 10, 2014, ScienceDirect, vol. 105, pp. 86-95 (Year: 2014).
U.S. Appl. No. 16/088,744, filed Sep. 26, 2018, Catalin Tutunaru.

* cited by examiner

FOOTBALL HELMET

CROSS REFERENCE TO RELATED APPLICATIONS

This application claims the benefit of U.S. Provisional Patent Application No. 62/452,577 filed Jan. 31, 2017, which is hereby incorporated by reference in its entirety.

FIELD OF THE INVENTION

The present invention relates to helmets and, in particular, to football helmets.

BACKGROUND OF THE INVENTION

In recent years, there has been a significant amount of research into the health risks associated with repetitive head trauma. In the game of American football ("football"), players are subjected to player-to-player contact and it is not uncommon for a player's head to strike the ground or another player. To prevent injuries to the head and face, football players wear a helmet with a hard shell, internal padding and a wire face guard. While the football helmets in the prior art generally protect players from broken bones and abrasions in their head and face, they are inadequate at protecting players from internal injuries, specifically injuries to the brain.

Studies have indicated that football players are susceptible to developing chronic traumatic encephalopathy ("CTE"), which is a degenerative disease that has been attributed to repetitive concussions or subconcussive impacts to the brain. Instead of preventing the concussions and subconcussive impacts that are theorized to cause CTE, the football helmets in the prior art can exacerbate trauma to the brain in certain impacts. For instance, when football players have head-to-head contact, the hard shell of prior art football helmets create a nearly elastic collision where the kinetic energy of the two helmets before the collision is nearly equal to their kinetic energy after the collision. This effect is similar to a first moving pool ball hitting a second stationary pool ball—after the impact, the first ball becomes stationary and the second ball begins to move at approximately the same rate as the first ball originally was moving. When football players experience head-to-head contact, the force of the impact is not absorbed by the prior art helmets, but rather, like a pool ball, the force is conserved and exerted on one or more player's head.

By not absorbing the energy of impacts, but instead conserving the energy, the football helmets in the prior art do not adequately protect the brain from concussions and subconcussive impacts. The nearly elastic collisions that are characteristic of the prior art football helmets also amplify the magnitude of force exerted on the neck and brain stem of players, potentially causing neck injuries or other brain injuries that are not yet known.

While prior art football helmets have a layer of padding inside the hard shell, the design of the padding is not adequate to support the head in an impact. The internal padding of a helmet is most effective when there is no gap between a player's head and the padding. In the prior art helmets, the padding often has gaps between the padding and a player's head unless the helmets are custom designed for that player's head. As most players are unable to purchase a helmet with padding custom designed for their head, most players have gaps between the padding and their head, reducing the effectiveness of the prior art helmet systems.

Therefore, there is a need for a football helmet that is better able to prevent the brain from receiving concussions and subconcussive impacts. There is also a need for a helmet that reduces the prevalence of gaps between a player's head and the internal padding of the helmet. Accordingly, it is the object of the present invention to provide a football helmet that prevents the brain from receiving concussions and reduces the magnitude of subconcussive impacts and that reduces the prevalence of gaps between a player's head.

BRIEF SUMMARY OF THE INVENTION

The present invention provides a football helmet that reduces the occurrence of concussions and the severity of subconcussive impacts to the brain when worn by football players. Football is not the only sport where CTE is a problem and other sports and activities would also benefit from the invention disclosed herein. The invention uses multiple materials and configurations that are novel to helmet applications and reduce the magnitude of impacts to the head, brain and neck.

The present invention is comprised of materials that are new to the field of football helmets. The materials used in the present invention can be grouped into the rigid core or frame of the helmet (hereinafter "rigid core"), the exterior impact absorbing system (hereinafter "EIAS") and the interior impact absorbing system (hereinafter "IIAS"). To reduce the prevalence of elastic collisions, the present invention uses an EIAS comprised of one or more durable, yet easily compressible materials fixed to the exterior surface of the rigid core. The EIAS is are capable of dissipating some or all of the energy from an impact. The present invention uses a rigid core to provide structure to the helmet and protect against head injuries during high pressure impacts. Fixed to the inside surface of the rigid core of the helmet is an IIAS comprised of one or more compressible materials that conform to a player's head, eliminating gaps between the IIAS and the player's head and absorbing some or all of the force of an impact. Because the IIAS also absorbs the force of an impact, impacts are absorbed by both the EIAS and IIAS.

The exemplary embodiments presented in this application are optimized for use in a football helmet, however, it is appreciated that the invention could be used in other types of helmets within the inventive concept expressed herein.

DETAILED DESCRIPTION OF THE INVENTION

Figure 1:
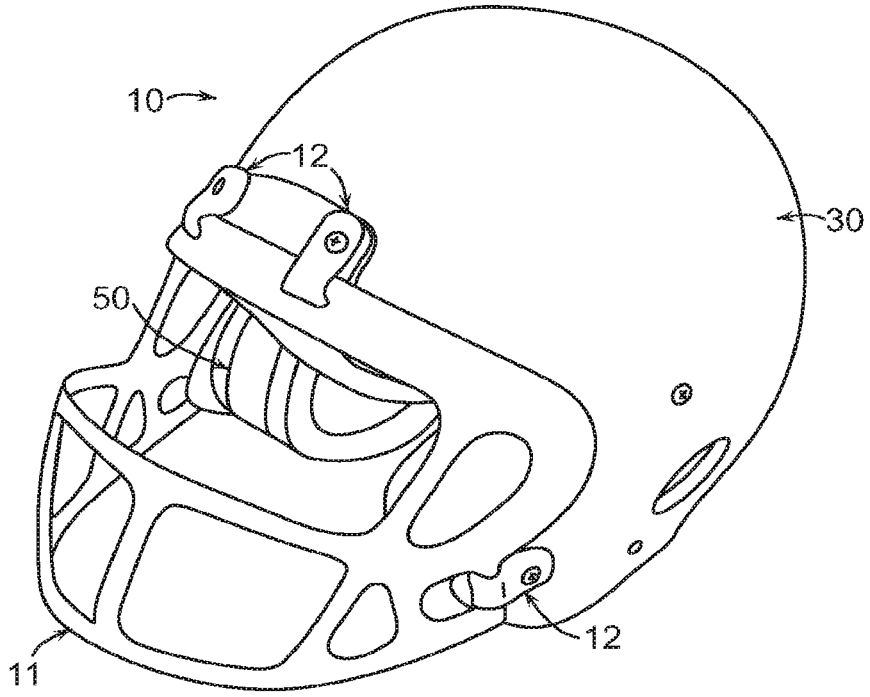
FIG. 1 is a perspective view of the preferred embodiment of the invention.

In FIG. 1 is a perspective view of the preferred embodiment of the invention, a football helmet 10, comprised of an EIAS 30, rigid core 40, an IIAS 50 and a facemask 14. The rigid core 40 does not need to be completely rigid in all embodiments. In some embodiments, the rigid core 40 is more rigid than the EIAS 30 or IIAS 50. In some embodiments, the rigid core 40 has a higher stiffness than the EIAS 30 or IIAS 50. In some embodiments, the rigid core 40 has a higher hardness than the EIAS 30 or IIAS 50. The rigid core 40 can also be referred to as the core layer. In this view, a facemask 11 is attached to the helmet 10 using facemask mounted snaps 12.

Visible in FIG. 1 is the exterior of the EIAS 30, which is comprised of multiple layers of materials in the preferred embodiment. While the preferred embodiment uses a two layer EIAS 30, it is appreciated that the number of layers may be added or subtracted within the inventive concept expressed herein. Depending on the particular conditions expected for the helmet, it may be desirable to increase or decrease the number of layers used in the EIAS, the materials used in the EIAS or the thickness of the layers used in the EIAS. For instance, a heavier player may require an EIAS 30 that is capable of dissipating a larger amount of impact energy than a lighter player.

A portion of the IIAS 50, fixed to the inside of the rigid core 40, is visible in FIG. 1. The IIAS 50 in the preferred embodiment uses four layers, however, it is appreciated that the number of layers may be added or subtracted within the inventive concept expressed herein. Depending on the particular conditions expected for the helmet 10, it may be desirable to increase or decrease the number of layers used in the IIAS, the materials used in the IIAS or the thickness of the layers used in the IIAS. For instance, a heavier player may require an IIAS that is capable of dissipating a larger amount of impact energy than a lighter player.

The facemask 11 is attached to the helmet using snaps 12 and is comprised of a novel material with respect to helmets. In one embodiment, the facemask 11 is comprised of a fiber reinforced polymer that has been modified to withstand the impact forces expected on the facemask without failure. In another embodiment, the facemask is comprised of a carbon fiber reinforced polymer. Carbon fiber reinforced polymer is generally defined as carbon fiber filaments combined with a resin to create a solid material. Carbon fiber reinforced polymers (hereinafter "carbon fiber") have a relatively high stiffness and high tensile strength for its weight, however, much of its strength is directional. Because the strength of carbon fiber is dependent on the orientation of the individual filaments, it can be very strong in a first direction and very brittle in a second direction.

In one embodiment of the facemask 11, it is comprised of carbon fiber, where most of carbon fiber filaments are oriented along the axes of the elongate bars 13 that comprise the facemask 11. This configuration optimizes the strength of the facemask 11 in impacts that load the elongate bars 13 in the axial direction. However, carbon fiber filaments can be weak and/or brittle when impacted in a direction normal to its elongate axis, making a conventional carbon fiber compound prone to cracking in this application. In one embodiment, the facemask 11 is modified with a rubberizing compound to increase the flexibility of the facemask 11 in impacts that are normal to the axial direction of the elongate bars. Many types of rubberizing compounds and flexibility promoters are known in the art and could be used in the construction of the facemask 11. In another embodiment, the resin used to bond the carbon fiber filaments of the facemask 11 is comprised of 30-50% epoxy laminating resin and 50-70% rubberizing compound. In another embodiment, the resin used to bond the carbon fiber filaments of the facemask 11 is comprised of 40% epoxy laminating resin and 60% rubberizing compound. In another embodiment, the resin used to bond the carbon fiber filaments of the facemask 11 is comprised of 35% epoxy laminating resin and 65% rubberizing compound. In another embodiment, the resin used to bond the carbon fiber filaments of the facemask has a hardness of approximately 6.50 on a 0 to 10 scale. The term "approximately" as used herein denotes the stated value along with a variation of 10% in the positive or negative direction.

Figure 2:
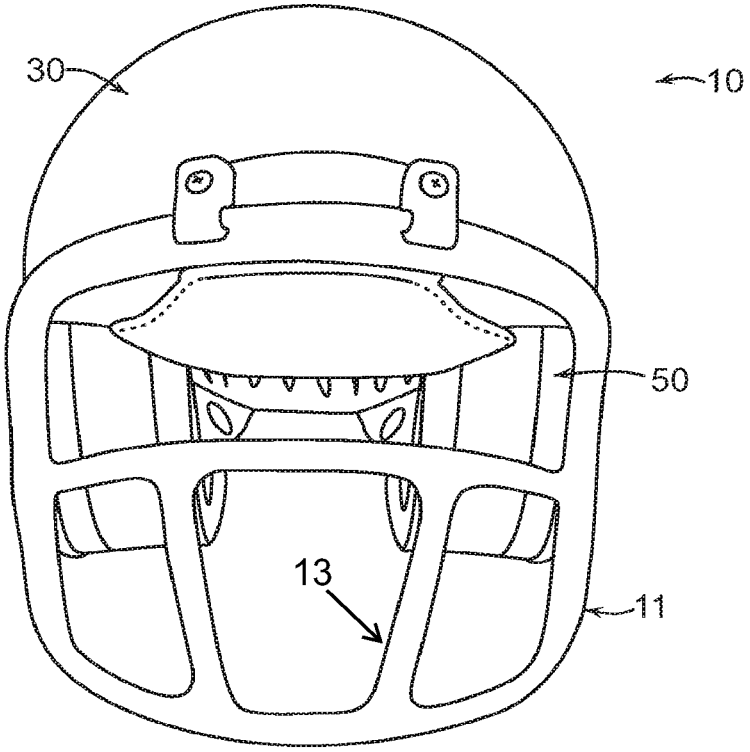
FIG. 2 is a front view of the preferred embodiment of the invention
Figure 3:
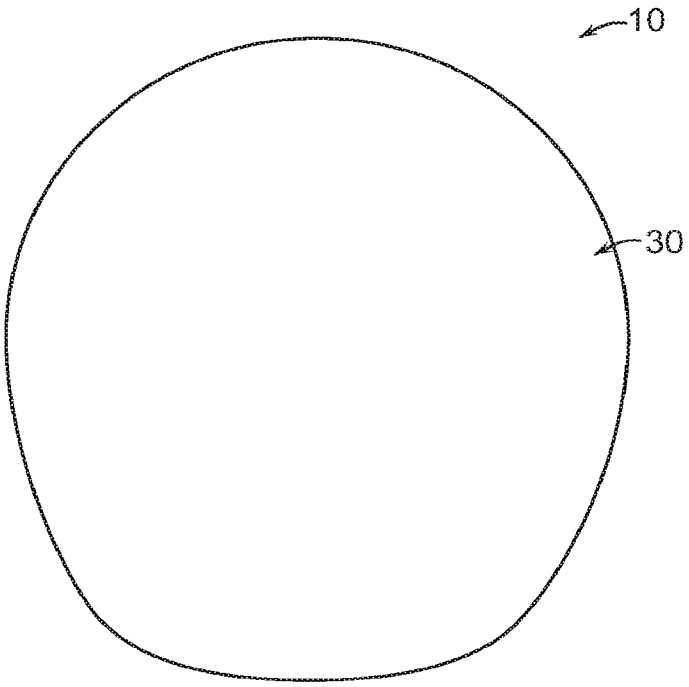
FIG. 3 is a rear view of the preferred embodiment of the invention.
Figure 4:
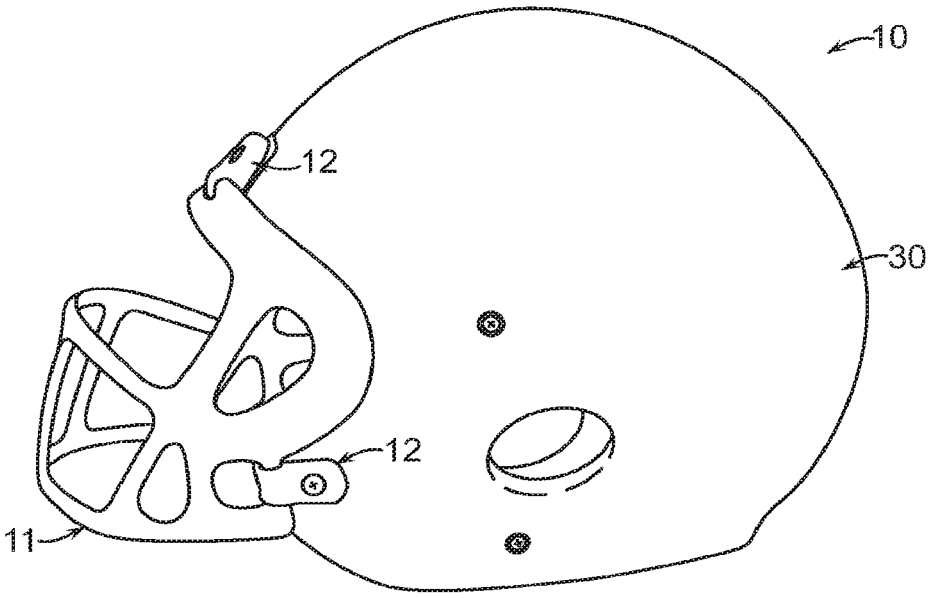
FIG. 4 is a side view of the preferred embodiment of the invention. The left side and right side are substantially mirror images of each other.
Figure 5:
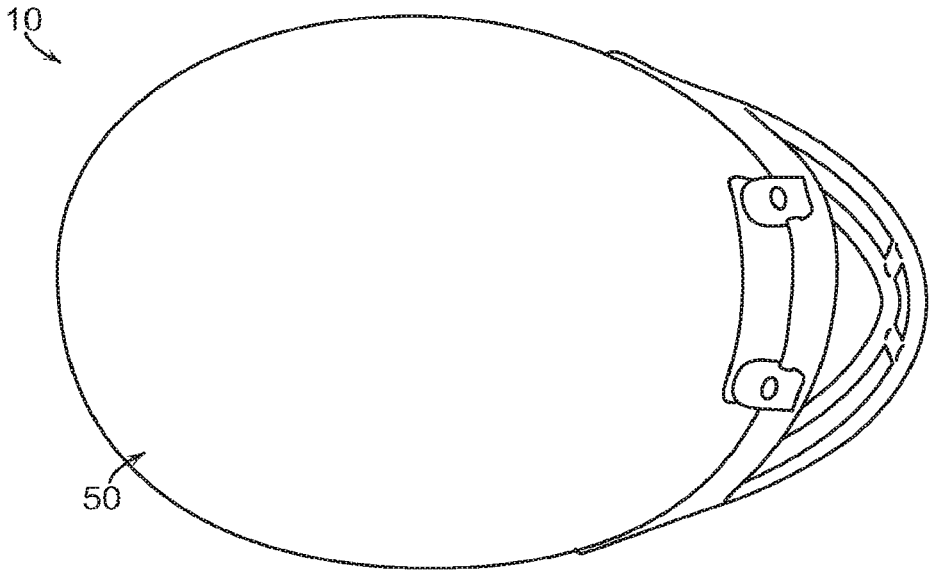
FIG. 5 is a top view of the preferred embodiment of the invention.

In FIGS. 2-5 are alternative views of the helmet 10. FIG. 2 is a front view of the helmet 10 with the facemask 11 attached. FIG. 3 is a rear view and FIG. 5 is a top view of the helmet 10.

FIG. 4 is a side view of the helmet 11, where the right side and left side views are mirror images of one another. Visible in this view are the EIAS 30 and the IIAS 50. The rigid core 40 is sandwiched between the EIAS 30 and IIAS 50 and hidden in this view. Towards the edges of the helmet or in the vicinity of the ear holes, the EIAS reduces in thickness so that it has a rounded convex cross section if viewed from the side. The rounded cross sections protect players from the edge of the rigid core 40 and prevent articles from placing a tangential load on the EIAS 30 in those areas.

Figure 6:
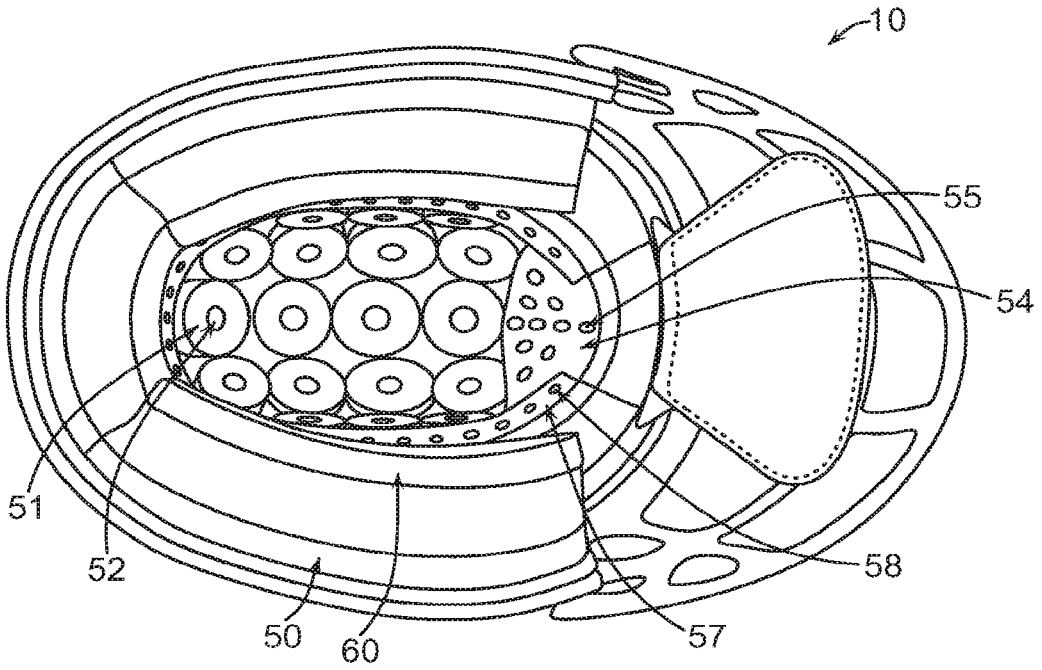
FIG. 6 is a bottom view of the preferred embodiment of the invention.

In FIG. 6 is a bottom view of the helmet 10 with components removed to expose the IIAS 50. Towards the top of the helmet 10, the IIAS 50 is comprised of cylindrical impact absorbing components 51 (hereinafter "foam cylinders"). While the components of the IIAS 50 are referred to as foam, they may be comprised of any material with adequate impact absorbing properties and/or contouring properties. Other materials that may be appropriate for use in the IIAS 50 include, but are not limited to, bladders containing a fluid (including gas, liquid, semifluid, semisolid), vinyl encased impact absorbing members or mechanical shock absorbing apparatuses.

In one embodiment, the foam cylinders 51 are further comprised of a cylindrical hole 52 oriented along the same axis as the foam cylinder 51. The cylindrical hole 52 is preferably oriented along the same axis of the foam cylinder 51, but there are situations where it may be preferable to offset the axes. Offsetting the axes would change the compressive properties of the foam cylinders 51 without having to change their material, diameter or height. The cylindrical holes 52 may be configured as through holes that extend from one end of the foam cylinder 51 to the other. The cylindrical holes 52 may also be configured as countersunk holes where their depth is less than the height of the foam cylinder 51. The cylindrical holes 52 may also be countersunk from either direction. In some embodiments, the foam cylinders 51 have more than one cylindrical hole 52 to reduce the weight of the foam cylinder and to change its impact absorption properties. In some embodiments, the foam cylinders 51 have a centrally located cylindrical hole 52 and a plurality of smaller holes located in the radial direction from the centrally located cylindrical hole. While the hole has been described as cylindrical for ease of manufacture, holes or voids of other shapes could be substituted. In some embodiments, the cylindrical hole 52 does not extend to either end of the foam cylinders 51 and, instead, is an internal void.

In the area of the helmet 10 that contacts a player's forehead is a forehead pad 54 comprised of an impact absorbing material with one or more holes 55. The forehead pad 54 is shaped to sit against the inside of the rigid core 40 and between the foam cylinders 51 and elongate strips 57. The elongate strips 57 are comprised of an impact absorbing material with one or more holes 58. The area below a player's ears and between the rigid core 40 and the player's head are further comprised of ear strips 60 that are comprised of an impact absorbing material, optionally comprised of one or more holes 61. Similar to the cylindrical holes 52 in the foam cylinders 51, the holes 55, 58 and 61 may be configured as through holes, countersunk from either direction or merely voids internal to the forehead pad 54.

Figure 7:
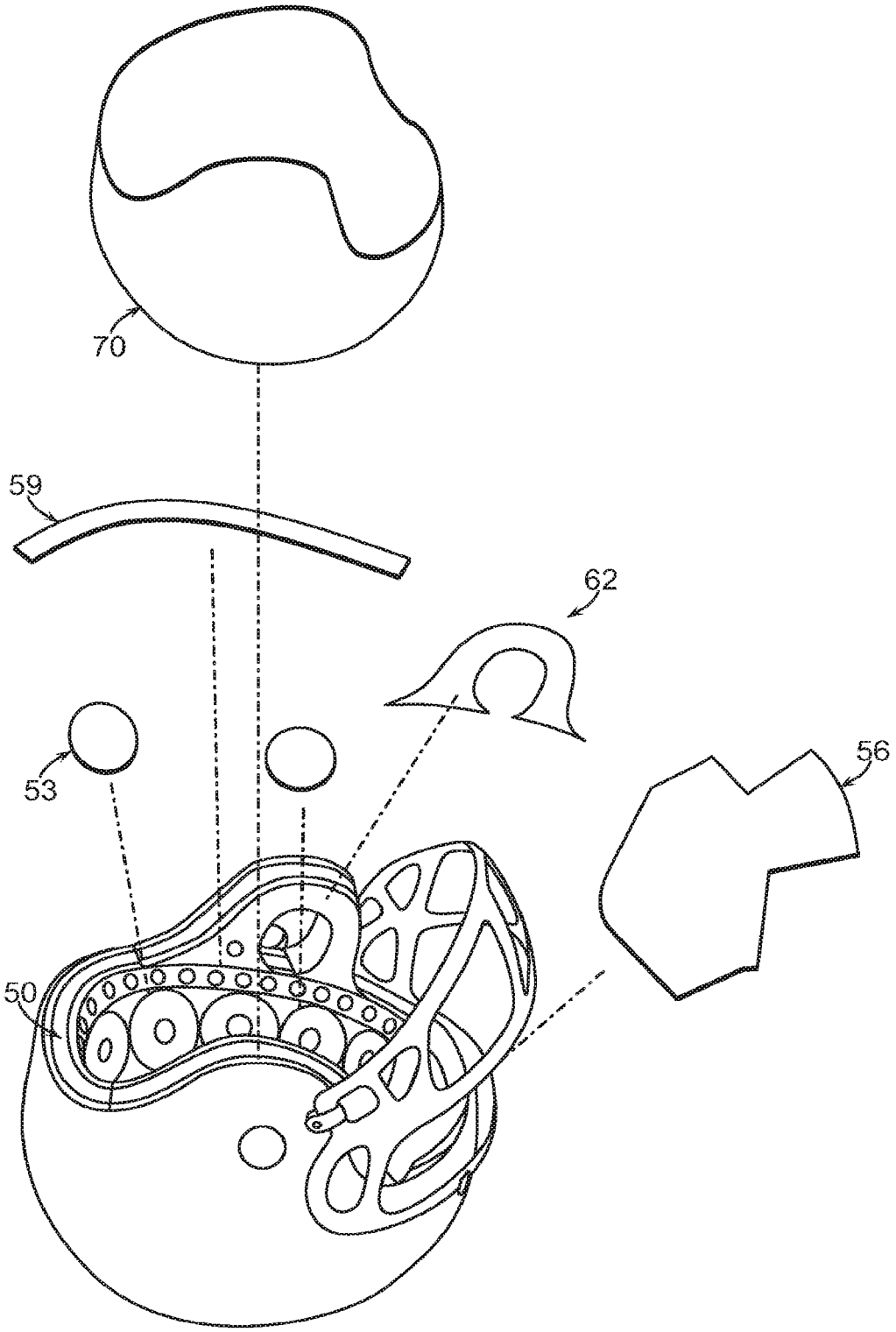
FIG. 7 is a bottom exploded isometric view of the preferred embodiment of the invention.

In FIG. 7 is an exploded perspective view of the helmet 10 with components of the IIAS 50 removed for clarity. The helmet 10 is optionally further comprised of a liner 70 removably fixed to the inner surface. The removable liner 70 can be comprised of a material that provides a wicking effect, anti-bacterial or anti-microbial effect or a moisture barrier effect, among others. Each individual impact absorbing component in the IIAS 50 has an air impermeable layer fixed to the end furthest from the rigid core 40.

For example, the foam cylinders 51 are fixed to the rigid core 40 on one end and a circular air impermeable layer 53 is fixed to the distal end. Similarly, the forehead pad 54, elongate strips 57 and ear strips 60 are fixed to the rigid core 40 on one end and an air impermeable layer 56, 59 and 62 is fixed to their respective distal end.

In one embodiment, the air impermeable layers 53, 56, 59 & 62 (hereinafter collectively "barrier" 63) are comprised of vinyl and fixed to the underlying portion of the IIAS 50 with an adhesive. In another embodiment, the barrier 63 is comprised of a plastic sheet adhered to the impact absorbing material. In another embodiment, the barrier 63 is a unitary article fixed to each foam section of the underlying IIAS 50. In another embodiment, the barrier 63 is not air impermeable, but rather is partially air permeable, allowing an amount of air to pass through the barrier 63.

The barrier 63 greatly increases the effectiveness of the IIAS 50 by utilizing the air trapped in the holes 52, 55, 58 & 61 to absorb impact energy. In one embodiment, the impact absorbing members 51, 54, 57 & 60 of the IIAS 50 are comprised of an open cell foam and the barrier 63 is comprised of an air impermeable material. When the impact absorbing members 51, 54, 57 & 60 are comprised of an open cell foam, the air contained in the holes 52, 55, 58 & 61 can only enter or exit the hole through the open cell structure of the foam, providing an impact absorbing benefit. The impact absorbing members 51, 54, 57 & 60 effectively become shock absorbers, where the air flow is regulated by the properties of the open cell foam. While particular shapes are disclosed herein for the impact absorbing members 51, 54, 57 & 60, many other shapes could easily be substituted.

In one embodiment, the impact absorbing members 51, 54, 57 & 60 are comprised of an open cell foam and the barrier 63 is comprised of a partially air permeable layer. When the barrier 63 is comprised of a partially or semi-permeable material with respect to air, the shock absorbing effect of the IIAS 50 is reduced. When the barrier 63 is partially permeable, the air contained in the holes 52, 55, 58 & 61 can exit through the open cell structure of the foam or the permeable structure of the barrier 63, allowing the air to escape at a greater rate.

The shock absorbing effect of the IIAS 50 may also be modified by changing the materials used in the IIAS 50 and the relationship between the size of holes 52, 55, 58 & 61 relative to their respective impact absorbing members 51, 54, 57 & 60. For example, increasing the diameter of the holes 52, 55, 58 & 61 relative to the size of their respective impact absorbing member 51, 54, 57 & 60 reduces the lateral distance that the air contained in the holes 52, 55, 58 & 61 must travel through the impact absorbing member 51, 54, 57 & 60 before escaping. By reducing the lateral distance, the air contained in the holes 52, 55, 58 & 61 can escape more easily, therefore reducing the impact absorbing capacity of the IIAS 50.

The shock absorbing effect of the IIAS 50 may also be modified by changing the lateral width of the impact absorbing members 51, 54, 57 & 60 relative to the diameter of the holes 52, 55, 58 & 61, changing the property of the materials used in the IIAS 50 and changing the thickness of the materials used in the IIAS 50. The shock absorbing effect of the IIAS 50 may also be changed in other ways that are known in the art.

Figure 8A:
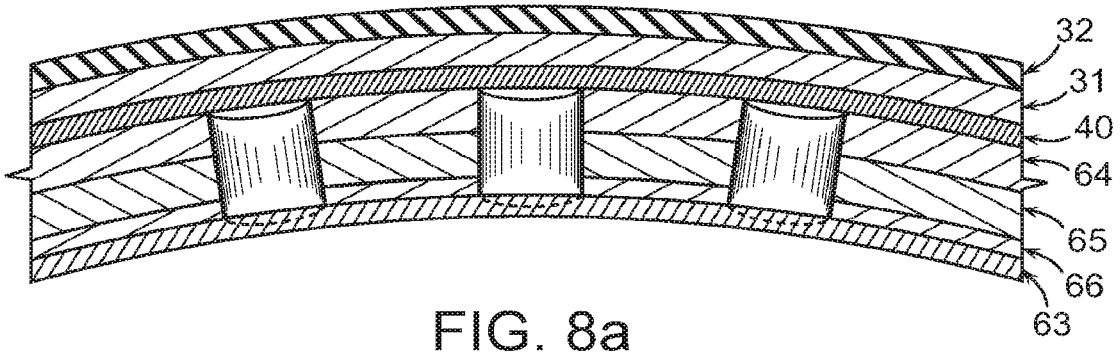
FIG. 8*a* is a side sectioned view of a portion of the preferred embodiment of the helmet, showing the EIAS, rigid core and IIAS.

In FIG. 8*a* is a side sectioned view of a portion of the helmet 10, showing the layering of materials that comprise the EIAS, rigid core 40 and the IIAS. The view in FIG. 8*a* is not necessarily to scale and is provided to show the positional relationship between the layers of materials. In the preferred embodiment disclosed herein, the EIAS is comprised of two layers and the IIAS is comprised of four layers, however, the number of layers, the thickness of the layers or the material used in the layers can be changed or optimized within the inventive concept expressed herein.

In the preferred embodiment, the IIAS 50 is comprised of one or more layers of viscoelastic polyurethane foam ("viscoelastic foam"). This material is also known as low-resilience polyurethane foam, memory foam or temper foam, along with other names. Viscoelastic foam is pressure and temperature sensitive and quickly molds to the contour of an object pressed against it. Viscoelastic foam's ability to mold around the contour of an object makes it an ideal material for the interior of a helmet. It's use inside a helmet allows the same helmet to contour to multiple players and eliminate gaps between the IIAS 50 and a player's head without resorting to an expensive helmet customization process.

Viscoelastic foam also provides effective impact cushioning and temperature control. Viscoelastic foam is excellent at absorbing impact and when used in the IIAS 50 and provides impact absorption between a player's head and the rigid core 40. Viscoelastic foam also stabilizes the temperature of objects placed against it. It tends to absorb and release heat slowly, allowing the material to stabilize the temperature of a player's skin.

In the preferred embodiment, the IIAS 50 is comprised of three layers of foam, each with different properties, fixed on one end to the inside of the rigid core 40 and sealed on its distal end by the barrier 63. In this embodiment, a first layer of foam 64 is fixed to the inner surface of the rigid core 40. Fixed to the first layer is a second layer of foam 65 and fixed to the second layer of foam 65 is a third layer of foam 66.

In some embodiments, the first layer of foam 64 is a soft to medium lightweight viscoelastic foam and the second layer of foam 65 is a firm lightweight viscoelastic foam. The terms soft, medium and firm refer to the relative difficulty to compress an area of foam, otherwise known as the firmness of the foam. A lightweight viscoelastic foam is capable of absorbing the energy of sudden impacts. A material that is particularly well suited for this purpose is an elastomeric, polyurethane viscoelastic open cell foam with a density between one quarter and 15 pounds per cubic foot. In this embodiment, the first layer 64 is comprised of a medium-soft lightweight viscoelastic foam with a density of one half to one pound per cubic foot and the second layer 65 is comprised of a firm lightweight viscoelastic foam with a density of one to one and a half pounds per cubic foot.

In this embodiment, the third layer of foam 66 fixed to the second layer of foam 65 is a viscoelastic foam with gel-like properties, an open cell structure and a soft dough-like consistency (hereinafter "gel-like foam"). Gel-like foam with a density between 15 and 50 pounds per cubic foot is particularly effective at maintaining its shape when worn by a user and providing effective impact cushioning. In some embodiments, a gel-like foam with a density between 15 and 33 pounds per cubic foot is used to provide effective impact cushioning in the helmet. In another embodiment, a gel-like foam with a density between 30 and 35 pounds per cubic foot is used in the first layer 64. An important characteristic of the gel-like foam used in this embodiment is that it is capable of easily molding around a player's head to eliminate gaps.

In the preferred embodiment, it is preferable that the first layer 64 and second layer 65 are substantially the same thickness and that the third layer 66 is 50-70% of the thickness of either the first or second layer 64 & 65. In this instance, substantially the same thickness means a thickness up to and including a 10% variation from one another, so that if the second layer is 1.0 inch thick, the third layer 66 would still be substantially the same with a thickness of 1.1 inches. While the use of viscoelastic foam has been disclosed as the preferred embodiment, it is appreciated that other materials with similar impact absorbing and density properties would also be suitable for this application.

In some embodiments, the first layer 64 comprises a medium lightweight viscoelastic foam with a thickness of about 0.3 to 0.75 inches, the second layer 65 comprises a medium soft lightweight viscoelastic foam with a thickness of about 0.30 to 0.75 inches and the third layer 66 comprises a gel-like foam with a thickness of about 0.20 to 0.50 inches and a density of about 15 pounds per cubic foot to 50 pounds per cubic foot. In some embodiments, the first layer 64 comprises a medium lightweight viscoelastic foam with a thickness of about 0.4 to 0.6 inches, the second layer 65 comprises a medium soft lightweight viscoelastic foam with a thickness of about 0.4 to 0.6 inches and the third layer 66 comprises a gel-like foam with a thickness of about 0.25 to 0.35 inches and a density of about 15 pounds per cubic foot to 50 pounds per cubic foot. In some embodiments, the first layer 64 comprises a medium lightweight viscoelastic foam with a thickness of about 0.45 inches to 0.55 inches, the second layer 65 comprises a medium soft lightweight viscoelastic foam with a thickness of about 0.45 to 0.55 inches and the third layer 66 comprises a gel-like foam with a thickness of about 0.25 to 0.32 inches and a density of about 15 pounds per cubic foot to 50 pounds per cubic foot. In some embodiments, the first layer 64 comprises a firm lightweight viscoelastic foam with a thickness of about 0.4 inches to 1.0 inch the second layer 65 comprises a medium lightweight viscoelastic foam with a thickness of about 0.3 to 0.75 inches and the third layer 66 comprises a gel-like foam with a thickness of about 0.2 to 0.5 inches and a density of about 15 pounds per cubic foot to 50 pounds per cubic foot. In some embodiments, the first layer 64 comprises a firm lightweight viscoelastic foam with a thickness of about 0.6 inches to 0.9 inches the second layer 65 comprises a medium lightweight viscoelastic foam with a thickness of about 0.4 to 0.6 inches and the third layer 66 comprises a gel-like foam with a thickness of about 0.25 to 0.35 inches and a density of about 15 pounds per cubic foot to 50 pounds per cubic foot. In some embodiments, the first layer 64 comprises a firm lightweight viscoelastic foam with a thickness of about 0.7 inches to 0.8 inches the second layer 65 comprises a medium lightweight viscoelastic foam with a thickness of about 0.45 to 0.55 inches and the third layer 66 comprises a gel-like foam with a thickness of about 0.25 to 0.32 inches and a density of about 15 pounds per cubic foot to 50 pounds per cubic foot.

In the preferred embodiment, the EIAS 30 is comprised of a layer 31 of lightweight viscoelastic foam fixed to the exterior of the rigid core 40 to absorb the impact energy from sudden impacts on the exterior of the helmet 10. In one embodiment, the layer 31 is comprised of an elastomeric, polyurethane viscoelastic open cell foam with a density between one half and 15 pounds per cubic foot. In another embodiment, the layer 31 is comprised of an elastomeric, polyurethane viscoelastic open cell foam with a density between one half and eight pounds per cubic foot. In another embodiment, the layer 31 is comprised of an elastomeric, polyurethane viscoelastic open cell foam with a density between one and two pounds per cubic foot. In another embodiment, the layer 31 is comprised of an elastomeric, polyurethane viscoelastic open cell foam with a density between one and one and a half pounds per cubic foot. While a viscoelastic foam is used in this embodiment, other materials capable of absorbing high impact energy would also be suitable.

The EIAS 30 is further comprised of a water-resistant layer 32 fixed to the top of the layer 31. Various waterproof layers or coatings would be suitable, including, but not limited to, a rubberized coating or room temperature vulcanization silicone. In some embodiments, a two part, flexible polyurethane adhesive is applied as the water-resistant layer 32. The two part, flexible polyurethane adhesive must be hard enough to resist scuffing and tearing, but also soft enough to remain flexible. Materials with a Shore hardness of A30 to A90 can be appropriate for use in the water-resistant layer 32. In some embodiments, the water-resistant layer 32 is comprised of a two part, flexible polyurethane adhesive with a Shore hardness between A40 and A70. In other embodiments, the water-resistant layer 32 is comprised of a two part, flexible polyurethane adhesive with a Shore hardness of approximately A50. In one embodiment, the layer 31 is three to six times as thick as the water-resistant layer 32. In another embodiment, the layer 31 is four to five times as thick as the water-resistant layer 32. In another embodiment, the water-resistant layer 32 is approximately 1.0 mm thick. To increase the abrasion resistance of the EIAS 30, the outer surface may optionally be wrapped with a flexible abrasion resistant material, such as a fiber reinforced cloth. Various reinforced materials would be suitable, including, but not limited to, Exotex® Dacron cloth.

In some embodiments, the EIAS 30 comprises a single layer of ethylene-vinyl acetate (hereinafter "EVA"). When the EIAS 30 comprises EVA, the material may be applied in sheet form at thicknesses of between and including 0.1 inches to 0.8 inches. When the EIAS 30 comprises EVA, it is preferable for the material to have a thickness of between and including 0.2 inches to 0.3 inches.

In the preferred embodiment, the rigid core 40 is a fiber reinforced polymer comprised of carbon fibers, aramid fibers and a resin. In one embodiment, the rigid core 40 is comprised of a layer of carbon fiber reinforced polymer on the exterior and a layer of Kevlar reinforced polymer (hereinafter "Kevlar") on the interior of the rigid core 40, where the layer of Kevlar is approximately three times the thickness of the layer of carbon fiber. This thickness ratio of Kevlar to carbon fiber provides an effective balance between strength, weight and durability against impact. In another embodiment, the layer of Kevlar on the interior of the rigid core 40 is about two times the thickness of the layer of carbon fiber on the exterior of the rigid core 40. A rigid core 40 comprised only of carbon fiber is possible, but rigid core 40 would need to be comparatively thick to be capable of sustaining repetitive impacts normal to the direction of the carbon fiber filaments. The Kevlar layer provides additional strength to the carbon fiber and is more flexible to impacts normal to the direction of the Kevlar fibers, making the rigid core 40 more resistant to cracking. In another embodiment, the rigid core 40 is comprised of a Kevlar layer and carbon fiber layer where the Kevlar layer is one to five times the thickness of the carbon fiber layer. In another embodiment, the rigid core 40 is comprised of a Kevlar layer and carbon fiber layer where the Kevlar layer is approximately 0.6 mm thick and the carbon fiber layer is approximately 0.2 mm thick. In some embodiments, the carbon fiber layer is located on the interior of the rigid core 40 and the Kevlar layer is located on the exterior of the rigid core 40.

In one embodiment, the rigid core 40 is modified with a rubberizing compound to increase the flexibility of the rigid core 40 in impacts that are normal to the axial direction of the carbon fiber filaments. Many types of rubberizing compounds and flexibility promoters are known in the art and could be used in the construction of the rigid core 40. In another embodiment, the resin used to bond the carbon fiber filaments and the Kevlar fibers of the rigid core 40 is comprised of 30-50% epoxy laminating resin and 50-70% rubberizing compound. In another embodiment, the resin used to bond the carbon fiber filaments and Kevlar fibers of the rigid core 40 is comprised of 40% epoxy laminating resin and 60% rubberizing compound. In another embodiment, the resin used to bond the carbon fiber filaments and Kevlar fibers of the rigid core 40 is comprised of 35% epoxy laminating resin and 65% rubberizing compound. In another embodiment, the resin used to bond the carbon fiber filaments and Kevlar fibers of the rigid core 40 has a hardness of approximately 6.50 on a 0 to 10 scale.

In some embodiments, the carbon fiber and Kevlar fibers are oriented to maximize the rigid core's 40 resistance to frontal and rear impacts. The carbon fiber and Kevlar cloth can be oriented so that the fibers towards the front and rear of the helmet are positioned horizontally and vertically in a woven pattern.

While carbon fiber and Kevlar are well suited for use as the rigid core 40, it is appreciated that there are multiple materials that would be suitable. For instance, Exotex® Dacron has a high strength to weight ratio that exceeds that of carbon fiber and would also be an ideal material for the rigid core 40 when combined with a plastic resin. Other type of basalt fiber based composite materials would have similar high strength and low weight characteristics. The purpose of the rigid core 40 is to provide structure to the helmet 10 and many materials could be suitable based on the desired weight, crush resistance and cost of the helmet.

Figure 8B:
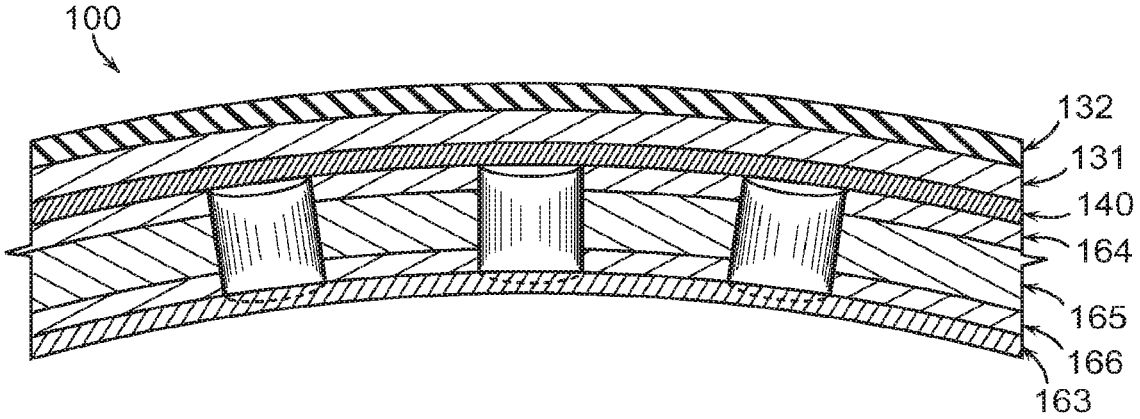
FIG. 8*b* is a side sectioned view of a portion of an alternative embodiment of the helmet, showing the EIAS, rigid core and IIAS.

In FIG. 8*b* is a side sectioned view of a portion of an alternative embodiment of the helmet 100, showing the layering of materials that comprise the EIAS, rigid core 140 and the IIAS. The view in FIG. 8*b* is not necessarily to scale and is provided to show the positional relationship between the layers of materials. In the alternative embodiment disclosed herein, the EIAS is comprised of two layers and the IIAS is comprised of four layers, however, the number of layers, the thickness of the layers or the material used in the layers can be changed or optimized within the inventive concept expressed herein.

In the alternative embodiment, the IIAS is comprised of three layers of foam, each with different properties, fixed on one end to the inside of the rigid core 140 and sealed on its distal end by the barrier 163. In the alternative embodiment, the first layer 164 fixed to the inside of the rigid core 140 is a soft to medium firmness lightweight viscoelastic foam is fixed to the inside of the rigid core 140. A layer of firm hardness lightweight viscoelastic foam, comprising the second layer 165, is fixed to the bottom of the soft to medium firmness foam. In this embodiment, the first layer 164 is comprised of a medium-soft lightweight viscoelastic foam with a density of one half to one pound per cubic foot and the second layer 165 is comprised of a firm lightweight viscoelastic foam with a density of one to one and a half pounds per cubic foot. In some embodiments, the first layer 164 is comprised of a lightweight viscoelastic foam with a density of one quarter to six pounds per cubic foot and the second layer 165 is comprised of a lightweight viscoelastic foam with a density of one half to six pounds per cubic foot.

In the alternative embodiment, the third layer 166 is comprised of a gel-like foam with a density between 30 and 35 pounds per cubic foot. In some embodiments, the third layer 166 is comprised of a gel-like foam with a density between 15 and 50 pounds per cubic foot.

In the alternative embodiment, it is preferable that the first layer 164 and third layer 166 are substantially the same thickness and that the second layer 165 is 125-175% of the thickness of either the first or third layer 164 & 166. In this instance, substantially the same thickness means a thickness up to and including a 10% variation from one another, so that if the second layer is 1.0 inch thick, the third layer 166 would still be substantially the same with a thickness of 1.1 inches. In some embodiments, the first layer 164 is approximately a half inch thick, the second layer 165 is approximately three quarters of an inch thick and the third layer is approximately a half inch thick. In some embodiments, it is preferable for the first layer 164 to be about 1.5 times the thickness of the second layer 165 and for the third layer to be about 0.6 times the thickness of the second layer 165. In some embodiments, it is preferable for the first layer 164 to be about the same thickness as the second layer 165 and for the third layer to be about 0.6 times the thickness of the second layer 165.

In the alternative embodiment, the EIAS is comprised of a layer 131 of lightweight viscoelastic foam fixed to the exterior of the rigid core 140 to absorb the impact energy from sudden impacts on the exterior of the helmet 100. In one embodiment, the layer 131 is comprised of an elastomeric, polyurethane viscoelastic open cell foam with a density between one half and 15 pounds per cubic foot. In another embodiment, the layer 131 is comprised of an elastomeric, polyurethane viscoelastic open cell foam with a density between one half and eight pounds per cubic foot. In another embodiment, the layer 131 is comprised of an elastomeric, polyurethane viscoelastic open cell foam with a density between one and two pounds per cubic foot. In another embodiment, the layer 131 is comprised of an elastomeric, polyurethane viscoelastic open cell foam with a density between one and one and a half pounds per cubic foot. While a viscoelastic foam is used in this embodiment, other materials capable of absorbing high impact energy would also be suitable. The EIAS of the alternative embodiment is further comprised of a water-resistant layer 132 fixed to the top of the layer 131. Various waterproof layers or coatings would be suitable, including, but not limited to, the materials disclosed for the water-resistant layer 32 of the preferred embodiment. The rigid core 140 of the alternative embodiment may be comprised of multiple suitable materials, including, but not limited to, the materials disclosed for the rigid core 40 of the preferred embodiment.

Figure 9:
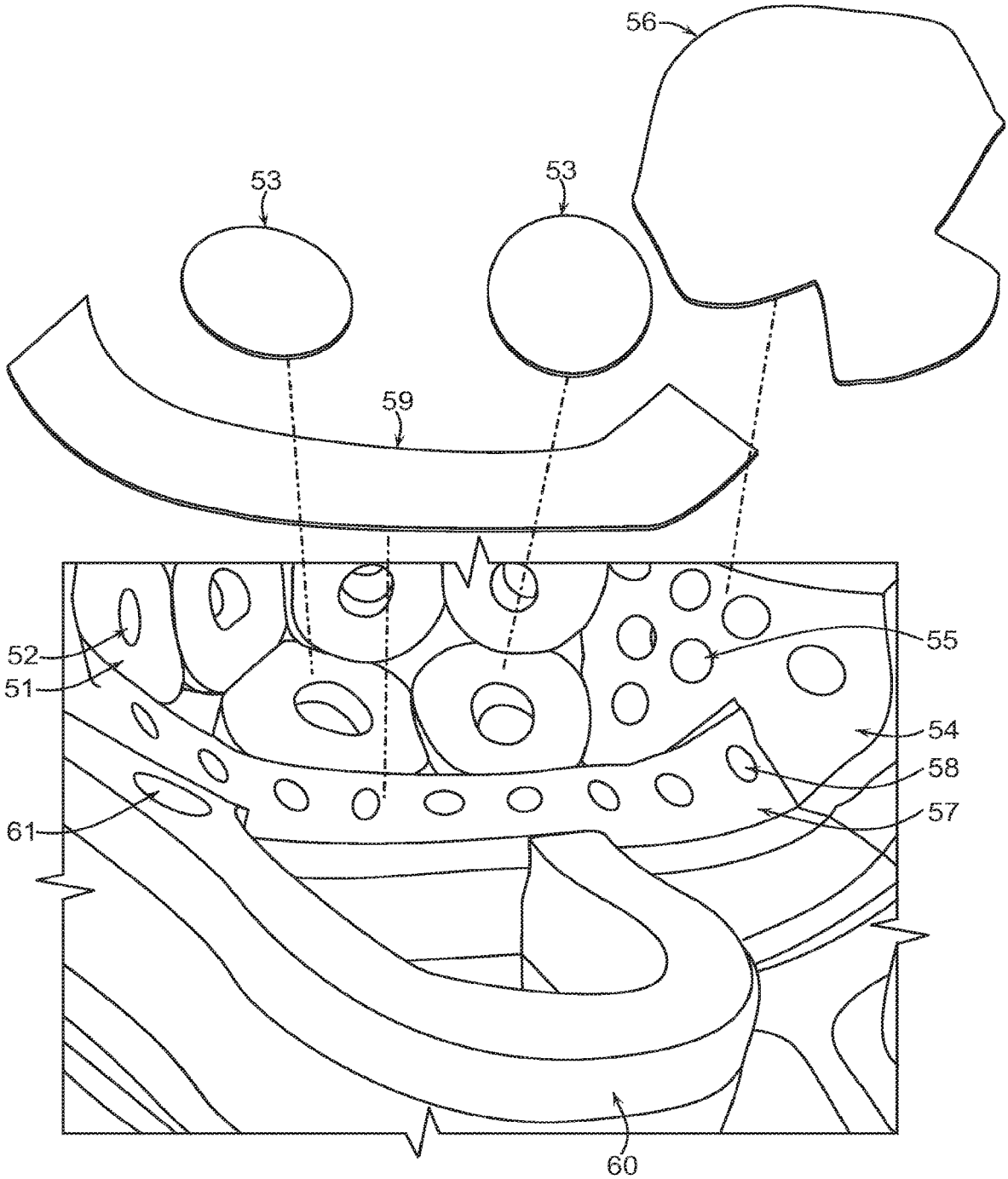
FIG. 9 is an exploded perspective view of a first portion of the interior of the preferred embodiment of the invention.
Figure 10:
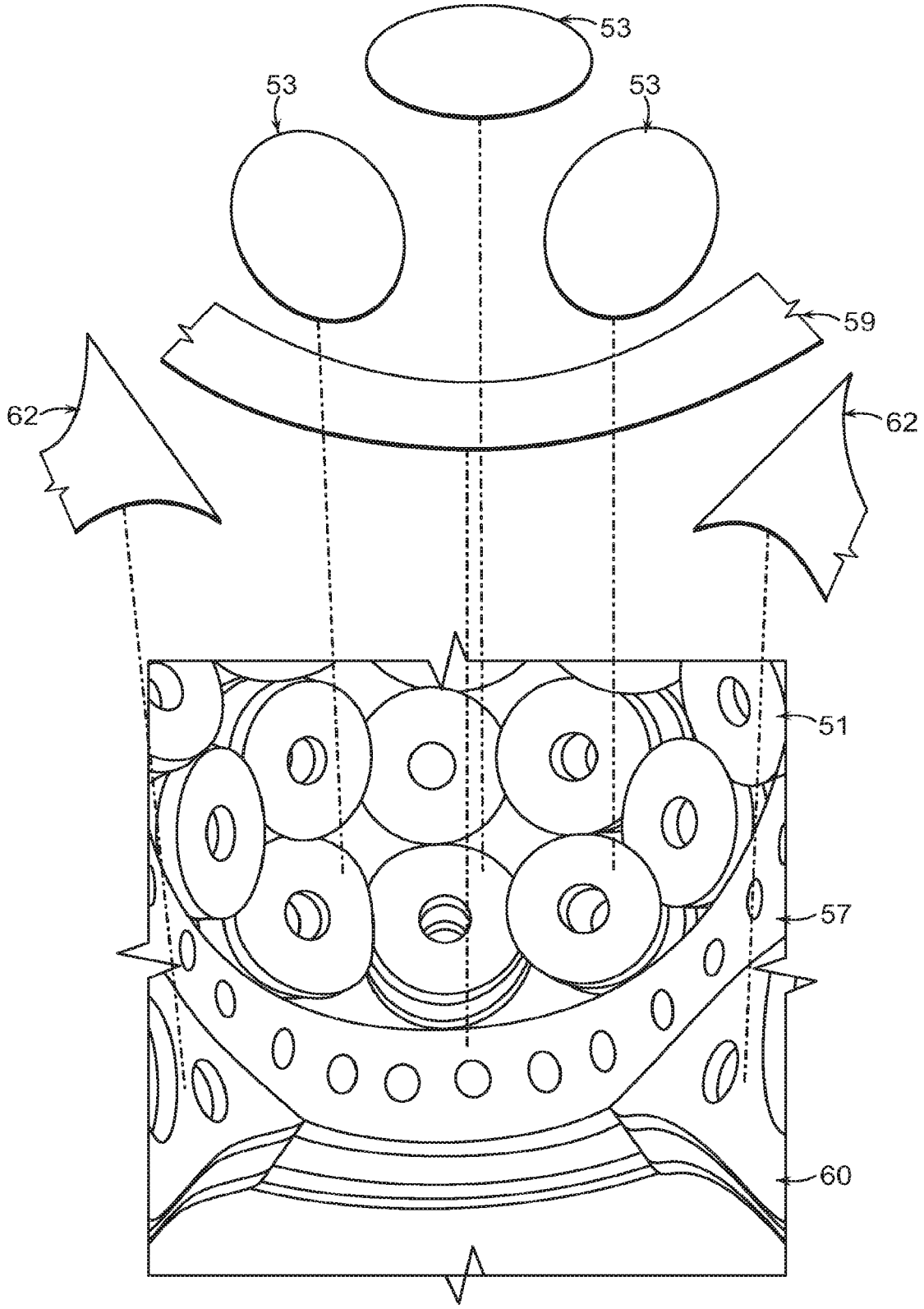
FIG. 10 is an exploded perspective view of a second portion of the interior of the preferred embodiment of the invention.
Figure 11:
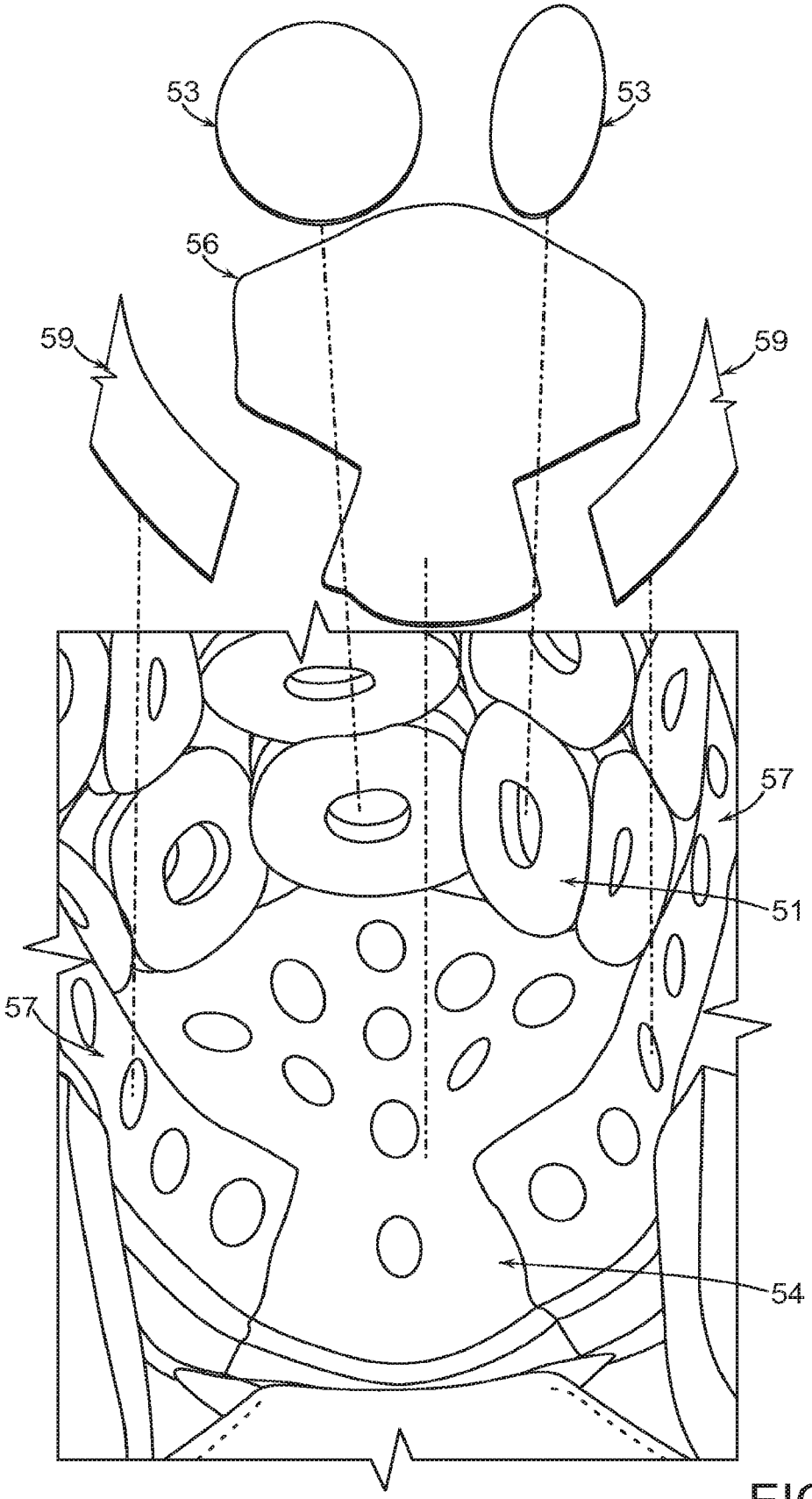
FIG. 11 is an exploded perspective view of a third portion of the interior of the preferred embodiment of the invention.

In FIGS. 9-11 are exploded perspective views of the inside of the helmet with components of the IIAS 50 removed for clarity. These figures show the sizing and position of each type of foam used in the preferred embodiment. Foam cylinders 51 are used to protect the top of a player's head to balance the weight of the IIAS 50 and its impact absorption qualities. The foam cylinders 51 are designed with an air void volume (contained in the cylindrical holes 52) to foam volume ratio that optimizes the impact absorption and weight of the IIAS 50.

The top of the helmet experiences high impact hits as well as many lower energy hits. Therefore, the top of the helmet must be soft enough to protect a player from lower energy subconcussive impacts and remain capable of protecting a player from high energy impacts. The IIAS 50 and the foam cylinders 51, in particular, are designed to deflect when subject to subconcussive impacts and absorb high energy impacts without bottoming out. Bottoming out in this application is when a material has been compressed to its minimum height. Bottoming out is undesirable in a helmet because once the impact absorbing material bottoms out, it cannot provide any substantial impact absorption.

The foam cylinders 51 are effective at providing absorption of subconcussive and high energy impacts because of the sealed air void located at their centers. An open cell foam can be readily compressed, however air in a sealed space is much more difficult to compress. The air in the center of the foam cylinders 51 is not completely sealed, in that it can escape through the open cell structure of the foam, but when subject to a high energy impact, the air momentarily acts similarly to air trapped in a sealed container to absorb the high energy impact. As the foam cylinder compresses, the air is pushed through the open cell structure of the foam, absorbing the remainder of the impact. The use of air in a void at the center of the foam cylinders 51 allows the use of a softer foam than would otherwise be appropriate because it reduces the risk of bottoming out in high energy impacts.

The forehead pad 54, elongate pieces 57 and ear pieces 60 use a smaller air void to foam ratio because they are subject to more high impact hits than the top of the helmet. The use of smaller air voids provides a level of protection from bottoming out while also providing shock absorption from the foam itself.

Figure 13:
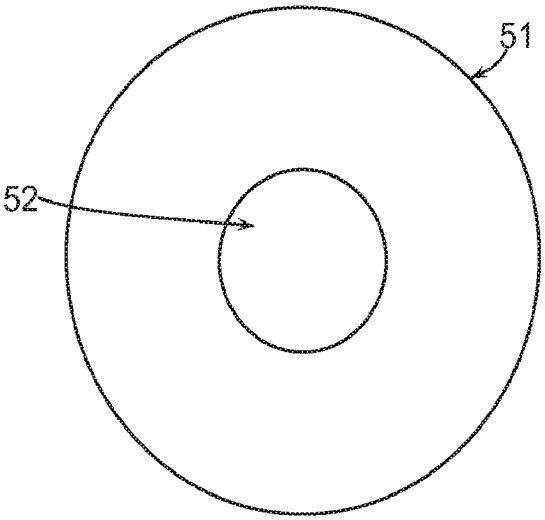
FIG. 13 is a top view of a cylindrical component used in the IIAS.
Figure 12:
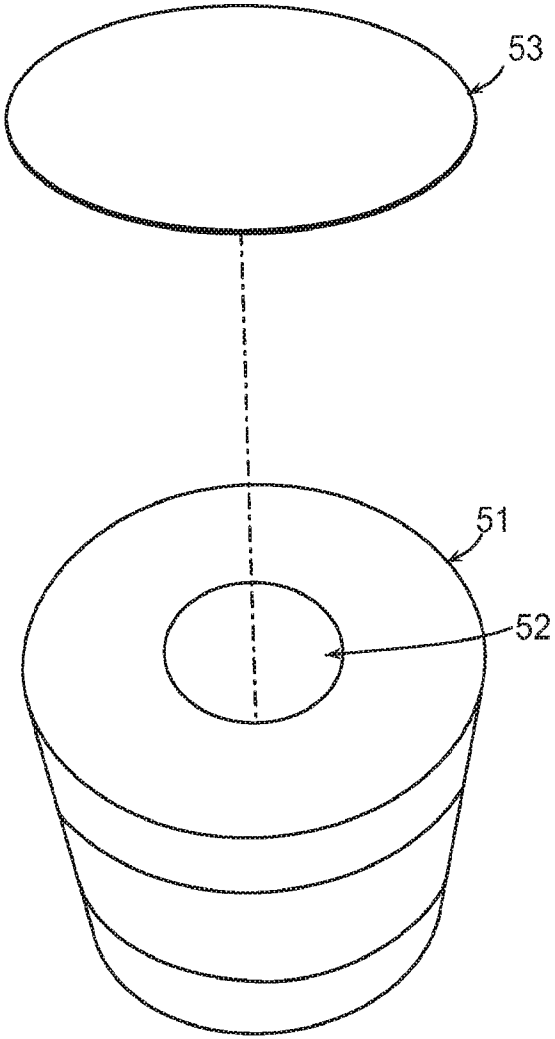
FIG. 12 is an exploded perspective view of a cylindrical component used in the IIAS.
Figure 15:
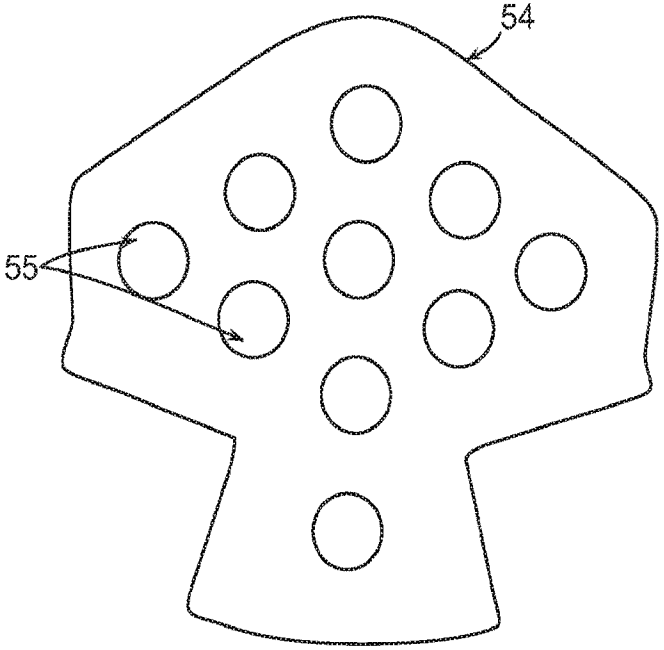
FIG. 15 is a top view of the forehead component used in the IIAS.
Figure 14:
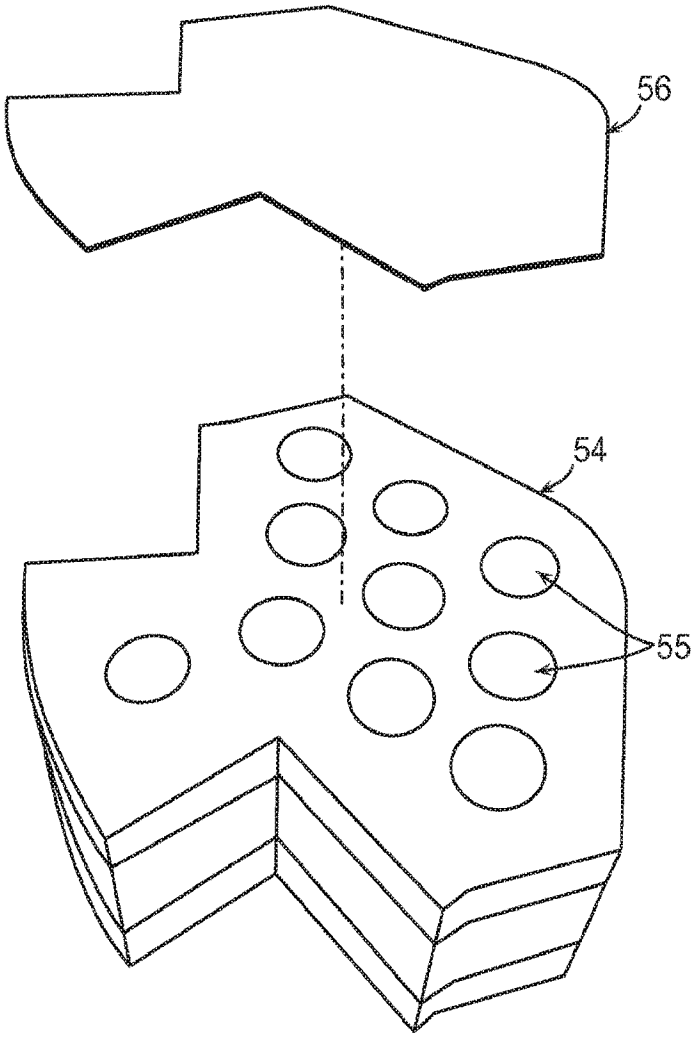
FIG. 14 is an exploded perspective view of the forehead component used in the IIAS.
Figure 16:
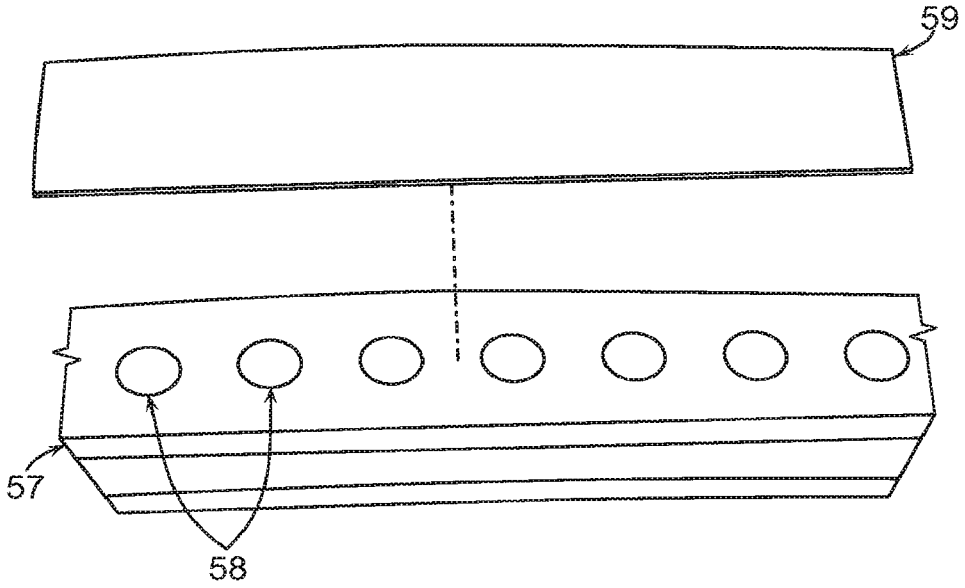
FIG. 16 is an exploded perspective view of an elongate component used in the IIAS.

In FIGS. 12-16 are detailed views of three types of foam components used in the IIAS 50. In FIGS. 12-13 is an example of a foam cylinder 51 with the vinyl barrier 53 removed. In FIGS. 14 & 15 is an example of a forehead pad 54 with the vinyl barrier 56 removed. In FIG. 16 is an example of an elongate pad 57 with the vinyl barrier 59 removed.

What has been described is a football helmet designed to reduce the occurrence of concussions and the magnitude of subconcussive impacts to the head. While this disclosure shows the invention as a football helmet, all or part of the invention is capable of being used in other applications. In this disclosure, there is shown and described only the preferred embodiments of the invention, but, as aforementioned, it is to be understood that the invention is capable of use in various other combinations and environments and is capable of changes or modifications within the scope of the inventive concept as expressed herein.

The invention claimed is:

1. A helmet comprising:

a core layer; and an inner layer fixed to at least a portion of an interior surface of the core layer, the inner layer comprising a plurality of impact absorbing elements, each comprising a proximal end fixed to the core layer and a distal end furthest from the core layer;

wherein at least one of the plurality of impact absorbing elements comprises at least one through hole that extends from its distal end to its proximal end, and the at least one of the plurality of cylindrical impact absorbing elements further comprises at least three layers of a viscoelastic foam having an open cell structure, the at least three layers comprising a third layer disposed furthest to the core layer and having a density greater than densities of other layers, a first layer disposed closest to the core layer and having a density less than the densities of the other layers, and a second layer disposed between the first layer and the third layer and having a density less the density of the third layer and greater than the density of the first layer.

2. The helmet of claim 1, wherein each impact absorbing element further comprises an air impermeable layer fixed to the distal end thereof.

3. The helmet of claim 1, wherein the plurality of impact absorbing elements comprise a foam having an open cell structure.

4. The helmet of claim 1, wherein the inner layer comprises at least one of: one or more layers of a viscoelastic polyurethane foam, one or more layers of a soft to medium light weight viscoelastic foam, one or more layers of firm light weight viscoelastic foam, one or more layers of a polyurethane viscoelastic open cell foam, one or more layers of a polyurethane viscoelastic open cell foam having a density ranging between one quarter and 15 pounds per cubic foot, one or more layers of a medium-soft lightweight viscoelastic foam with a density ranging between one half to one pound per cubic foot, one or more layers of a firm lightweight viscoelastic foam with a density ranging between one to one and a half pounds per cubic foot, one or more layers of a viscoelastic foam having a density ranging between 15 and 50 pounds per cubic foot, one or more layers of a viscoelastic foam having a density between 15 and 33 pounds per cubic foot, one or more layers of a foam having a density ranging between 30 and 35 pounds per cubic foot, one or more layers of a polyurethane viscoelastic foam having an open cell structure, one or more layers of a polyurethane viscoelastic open cell structure foam having a density ranging between one half and 15 pounds per cubic foot, one or more layers of an elastomeric, polyurethane viscoelastic open cell structure foam having a density ranging between one half and eight pounds per cubic foot, one or more layers of an elastomeric, polyurethane viscoelastic open cell structure foam having a density ranging between one and two pounds per cubic foot, and one or more layers of an elastomeric, polyurethane viscoelastic open cell structure foam having a density ranging between one and one and a half pounds per cubic foot.

5. The helmet of claim 1, further comprising an outer layer fixed to at least a portion of an exterior surface of the core layer, the outer layer comprising one or more layers of an elastomeric, viscoelastic polyurethane open cell structure foam.

6. The helmet of claim 5, wherein said one or more layers of an elastomeric, viscoelastic polyurethane open cell structure foam has a density ranging between two and 15 pounds per cubic feet.

7. The helmet of claim 1, further comprising a facemask coupled to the helmet using at least one snap.

8. The helmet of claim 7, wherein the facemask comprises at least one of carbon fiber filaments and one or more rubberizing compounds.

9. The helmet of claim 1, further comprising an outer layer fixed to at least a portion of an exterior surface of the core layer, the outer layer comprising a layer of ethylene-vinyl acetate.

10. The helmet of claim 1, wherein the core layer comprises a layer of carbon fiber and a layer of reinforced polymer, wherein the layer of reinforced polymer comprises a thickness of one to five times greater than a thickness of the layer of carbon fiber.

11. A helmet, comprising:

a core layer;

an inner layer fixed to an interior surface of the core layer; and a plurality of cylindrical impact absorbing elements fixed to at least a portion of the inner layer, each cylindrical impact absorbing element comprising:

at least one through hole extending along an axial direction of the impact absorbing element;

an air impermeable layer fixed to a surface of the cylindrical impact absorbing element furthest from the core layer; and a foam having an open cell structure;

wherein at least one of the plurality of cylindrical impact absorbing elements further comprises at least three layers of a viscoelastic foam having the open cell structure, the at least three layers comprising a third layer disposed furthest to the core layer and having a density greater than densities of other layers, a first layer disposed closest to the core layer and having a density less than the densities of the other layers, and a second layer disposed between the first layer and the third layer and having a density less the density of the third layer and greater than the density of the first layer.

12. The helmet of claim 11, wherein the density of the third layer comprises a range varying between 15 pounds and 50 pounds per cubic foot.

13. The helmet of claim 11, wherein the density of the first layer comprises a range varying between 0.25 and 15 pounds per cubic foot.

14. The helmet of claim 11, wherein the density of the second layer comprises a range varying between 1 and 1.5 pounds per cubic foot.

15. The helmet of claim 11, wherein the first layer comprises a thickness equal to a thickness of the second layer.

16. The helmet of claim 15, wherein the third layer comprises a thickness that is 50 percent to 70 percent of the thickness of the first layer.

17. A helmet comprising:

a core layer; and an inner layer fixed to at least a portion of an interior surface of the core layer, the inner layer comprising:

a plurality of impact absorbing elements, each comprising:

a proximal end fixed to the core layer;

a distal end furthest from the core layer; and an air impermeable layer fixed to the distal end;

wherein at least one of the plurality of cylindrical impact absorbing elements further comprises at least three layers of a viscoelastic foam having an open cell structure, the at least three layers comprising a third layer disposed furthest to the core layer and having a density greater than densities of other layers of the at least one of the plurality of cylindrical impact absorbing elements, a first layer disposed closest to the core layer and having a density less than the densities of the other layers of the at least one of the plurality of cylindrical impact absorbing elements, and a second layer disposed between the first layer and the third layer and having a density less the density of the third layer and greater than the density of the first layer.

* * * * *